US008101562B2

(12) United States Patent
Classen

(10) Patent No.: US 8,101,562 B2
(45) Date of Patent: Jan. 24, 2012

(54) METHOD FOR MECHANICAL CLEANING OF TEXTILES OR SOLID OBJECTS UTILIZING AN ENCAPSULATED ENZYME

(75) Inventor: Egbert Classen, Wertingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 89 days.

(21) Appl. No.: 11/713,339

(22) Filed: Mar. 2, 2007

(65) Prior Publication Data

US 2007/0155643 A1 Jul. 5, 2007

Related U.S. Application Data

(60) Division of application No. 10/422,210, filed on Apr. 24, 2003, now abandoned, which is a continuation of application No. PCT/EP01/12365, filed on Oct. 25, 2001.

(30) Foreign Application Priority Data

Oct. 27, 2000 (DE) ..... 100 53 416

(51) Int. Cl.
*C11D 3/386* (2006.01)

(52) U.S. Cl. ..... 510/226; 510/276; 510/220; 510/300; 510/305; 510/320; 510/349; 510/392; 68/9; 68/27; 134/94.1; 222/651; 222/638; 8/158

(58) Field of Classification Search ..... 510/226, 510/220, 276, 300, 305, 320, 349, 392
See application file for complete search history.

(56) References Cited

U.S. PATENT DOCUMENTS

| | | | | | |
|---|---|---|---|---|---|
| 3,567,076 | A | * | 3/1971 | Zanussi | 222/144 |
| 3,727,434 | A | * | 4/1973 | Bochan | 68/17 R |
| 3,747,645 | A | * | 7/1973 | Holster et al. | 137/838 |
| 3,942,341 | A | * | 3/1976 | Sang | 68/17 R |
| 3,950,277 | A | * | 4/1976 | Stewart et al. | 8/137 |
| 3,975,931 | A | * | 8/1976 | Bischkopf | 68/17 R |
| 4,016,040 | A | * | 4/1977 | Win et al. | 510/530 |
| 4,107,065 | A | * | 8/1978 | Gray | 510/313 |
| 4,365,853 | A | * | 12/1982 | Ehrlich | 312/42 |
| 4,745,021 | A | | 5/1988 | Ping, III et al. | |
| 4,756,844 | A | | 7/1988 | Walles et al. | |
| 4,777,682 | A | * | 10/1988 | Dreher et al. | 8/158 |
| 5,078,301 | A | * | 1/1992 | Gladfelter et al. | 222/52 |
| 5,133,892 | A | * | 7/1992 | Chun et al. | 510/224 |
| 5,208,930 | A | * | 5/1993 | Chabard | 8/158 |
| 5,768,917 | A | * | 6/1998 | Freida | 68/17 R |
| 6,277,153 | B1 | * | 8/2001 | Van Kouwen et al. | 8/137 |

FOREIGN PATENT DOCUMENTS

| | | | |
|---|---|---|---|
| DE | 4219620 | A1 | 12/1993 |
| DE | 4324202 | A1 | 12/1994 |
| DE | 19907764 | A1 | 11/1999 |
| EP | 0976819 | A1 | 2/2000 |
| EP | 0979866 | A1 | 2/2000 |
| GB | 2254857 | A | 10/1992 |
| GB | 2339579 | A | 2/2000 |
| WO | 96/15710 | | 5/1996 |
| WO | 00/50557 | | 8/2000 |
| WO | 01/25527 | A1 | 4/2001 |
| WO | 02/29150 | A1 | 4/2002 |

OTHER PUBLICATIONS

"Waschmittelchemie", Dr. Alfred Hüthig Verlag, Heidelberg 1976, pp. 166 and 167.

* cited by examiner

*Primary Examiner* — Charles Boyer
(74) *Attorney, Agent, or Firm* — James E. Howard; Andre Pallapies

(57) ABSTRACT

Water-soluble detergents and enzymes are used for mechanically cleaning textiles or crockery. According to the invention, enzymes with a catalytic effect on typical stains are added to the washing or cleaning process, only for as long as their catalytic effect is desired. This avoids superfluous removal of the enzymes that have been used in a washing or cleaning process.

20 Claims, 1 Drawing Sheet

Figure 1:
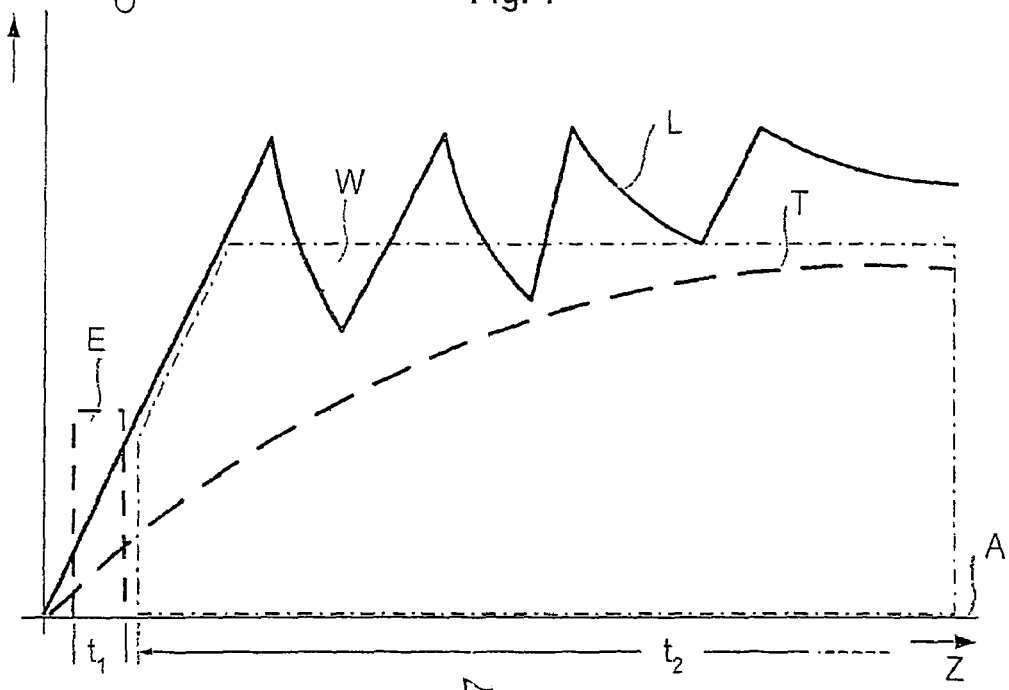

METHOD FOR MECHANICAL CLEANING OF TEXTILES OR SOLID OBJECTS UTILIZING AN ENCAPSULATED ENZYME

This application is a Divisional, under 35 U.S.C. §121, of U.S. application Ser. No. 10/422,210, filed Apr. 24 2003, which is a continuation, under 35 U.S.C. §120of International Application No. PCT/EP01/12365, filed Oct. 25, 2001, which designated the United States; this application also claims the priority, under 35 U.S.C. §119, of German patent application No. 100 53 416.3, filed Oct. 27, 2000; the prior applications are herewith incorporated by reference in their entirety.

The invention is based on a method for mechanically cleaning textiles or solid objects such as crockery using water-soluble detergents and/or cleaning agents and enzymes.

Up to now, commonly used methods of the kind described above (DE 43 24 202 A1) have used enzymes to boost the cleaning effect of e.g. alkaline cleaning agents for the duration of the impact. In modern washing systems for instance, enzymes are added to the washing process in the form of a powder. Depending upon the type of staining different enzymes are required which means that adequate stock provisions are necessary and that the selection and metering operation is costly. Not only are carbohydrates and proteins dissolved or decomposed during the washing process, but due to the presence of alkaline cleaning agents the enzymes themselves are also attacked and either decomposed or, at the very least, rendered ineffective. Finally enzymes not destroyed are washed away with the washing liquid after each washing cycle and must therefore be continuously added again.

The invention is based on the requirement to prevent the enzymes from dissolving or becoming ineffective and to ensure that still usable enzymes are not washed away.

According to the invention the requirement is met in that catalytically active enzymes are added to the washing or cleaning process for removing typical stains, but only for as long as their catalytic effect is desired. Since the catalytic effect of the enzymes is of good use only in the low-temperature range and, if possible, without alkaline cleaning agents being present, the enzymes, once they have been put to use, may be removed again from the washing process and reused in a later washing process.

The method according to the invention may be employed in a particularly advantageous manner with a detergent or cleaning agent where the enzymes are macroscopically encapsulated by means of a polymer membrane which is permeable to washing liquids but insoluble in water. As a result the catalytic effect may be effected through the membrane without the enzymes dispersing in the washing or cleaning-liquid.

If, according to a further advantageous development of the invention the capsules consist of several hollow bodies linked to one another, then this is the easiest way of keeping the enzyme-loaded membrane bodies separate from the circulating washing liquid, e.g. while this is being pumped out. The hollow bodies can thus be linked to form cartridges and/or bars and/or tubular bodies. In this way they become a larger unit which is easy to mechanically retain in the circulating washing liquid.

Furthermore, since with the application of the method according to the invention the enzymes become gradually exhausted, for which alkaline residues and temperature-dependent decomposition processes are responsible, the capsules or linked hollow bodies, according to a particularly advantageous development, may be stationarily but replaceably arranged at a location in a machine for cleaning textiles or solid objects (e.g. crockery), which is accessible to the washing or cleaning liquid.

In such a case, the location is best protected by a filter against insoluble impurities in the washing or cleaning liquid.

In order to cover all kinds of protein-based or carbohydrate-based stains in the enzyme-phase of the washing or cleaning process, the capsules or hollow bodies are preferably filled with enzymes suited to different kinds of stains. It is best to provide a specific enzyme for each kind of stain occurring in mechanically applied washing or cleaning processes.

With reference to an embodiment illustrated in the drawing both the method according to invention and a washing machine controllable by the method are schematically drawn. In the drawing FIG. 1 shows a time lapse diagram of the water inflow operations, the rising temperature progression and the sections for the addition of a cleaning agent or for the washing liquid to make contact with an enzyme-based detergent or cleaning agent according to the invention, and FIG. 2 shows a washing liquid container of a washing machine with water and detergent inflow connections and for circulating the washing liquid through an enzyme container.

Figure 2:
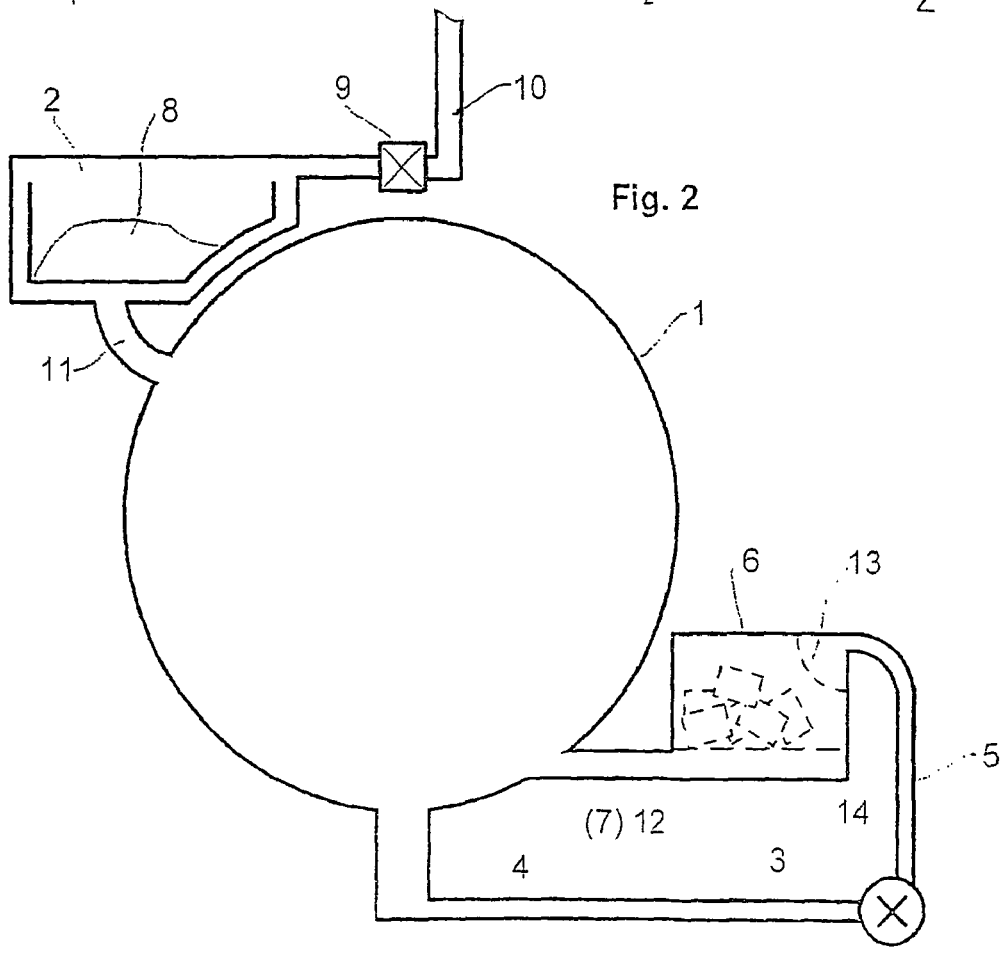

The ordinate O of the diagram in FIG. 1 contains scales not marked in detail for the quantity of washing liquid L in washing liquid container 1 of the washing machine shown in FIG. 2, for the temperature T of the washing liquid and for the respective quantities of detergents W and enzymes E. A time scale Z not marked in detail has been entered on the abscissa A.

The washing process illustrated in the diagram in FIG. 1 starts with water flowing into washing liquid container 1. As soon as a certain washing liquid level L has been reached, the washing liquid is brought into contact with a quantity of enzymatic detergent or cleaning agent E, which attacks protein- and carbohydrate-based stains in a batch of washing, for a limited amount of time t1, during which the temperature of the washing liquid is still low. Thereafter an alkaline detergent W is e.g. introduced into the washing liquid L, and this remains dissolved in the washing liquid over an undefined amount of time t2 while acting upon the dissolved proteins and carbohydrates as well as other stains in the batch of washing so as to remove the stains. The areas below the diagram lines for enzyme E and detergent w illustrate the difference between individual degrees of impact.

The inflow of water which bypasses a detergent container 2 for the first phase of the water inflow in FIG. 1 is not shown in FIG. 2. Once a certain amount of admitted water, however, covers the floor of washing liquid container 1 and has already wetted the washing, the washing liquid pump 3 in the example in FIG. 2 is switched on, and the admitted water, insofar as it is not absorbed by the washing, is fed to the enzyme container 6 through the discharge pipe 4 on the floor of the washing liquid container and the circulation pipe 5. There it takes up a limited quantity of the provisioned enzymes 7 and transports them into the washing liquid container 1, from where they are taken up by the batch of washing together with the washing liquid which is again wetting the washing. In this way the entire of batch of washing is gradually acted upon by enzymes due to the continuing exchange of water and washing liquid bound in the washing. During this process proteins and carbohydrates are split up. The enzyme phase finishes when the pump 3 is switched off.

After the enzyme phase is finished, detergent 8 is washed out of detergent container 2 due to water being admitted from water main 10 during opening of valve 9, and fed to washing liquid container 1 via pipe 11. Then, possibly while more water is being admitted to make up a desired quantity of washing liquid L, and while the washing liquid is being heated by means of a heater not shown up to a desired temperature T, the detergent W may act upon the split-up proteins and carbohydrates and upon the other stains in the batch of washing and remove them from the washing. Later on, they will be pumped out of the washing liquid container 1 together with the spent washing liquid into a waste water main in a manner not shown.

Innovations in process technology (Microsystems) may be utilised to cover enzymes 7 with a thin, porous polymer membrane which retains the enzymes in a capsule, but allows for an exchange of substances with the surroundings (required for the decomposition process of the proteins and carbohydrates during washing). Appropriate quantities of such macroscopic capsules may be combined in containers 12 (sieve-like cartridges or individual capsules linked together to form larger structures such as bars, tubular bodies etc.) to form bundles for the respective process and thus be retained as part of the machine in the hydraulic cycle 3 to 6. In order to protect the surface of the capsules against staining which would reduce or prevent an exchange of substances, suitable filters 13 might be arranged in front of the entry and 14 in front of the outlet of enzyme container 6, or a suitable design for the washing process might be found.

The method according to the invention and the associated detergent or cleaning agent thus include the possibility for completely avoiding regular additions of detergent by the customer. Neither conventional environment-polluting tenside detergents nor enzymatic detergents in the form of powder are required when using the method and the detergent or cleaning agent according to the invention. The still required detergent, e.g. in the form of cartridges, will continue to be used for supplying the machine with a treatment agent—perhaps not for the duration of the life of a washing machine or dishwasher, but certainly for a sustained period of time. Manual or automatic single-metering of detergents or cleaning agents according to the invention for each washing operation is no longer necessary, which means less work for the customer and more protection for the environment.

In order to meet the various requirements for enzymes depending upon the type of staining, each type of enzyme may be housed in its own structure or its own cartridge, or mixtures of different enzymes may be housed in one structure or one cartridge.

The invention claimed is:

1. A method for washing objects in a washing device including a washing liquid container, an enzyme container, and a detergent container, the method comprising the acts of:

providing enzymes in the enzyme container, the enzymes being retained in at least one capsule provided in the enzyme container;

providing a detergent in the detergent container;

starting a first washing cycle and introducing an initial washing liquid into the washing liquid container;

circulating the initial washing liquid from the washing liquid container through the enzyme container and back into the washing liquid container to transport a limited quantity of the enzymes retained in the at least one capsule into the washing liquid container for a first time period, the at least one capsule being permeable to said washing liquid but insoluble in water;

stopping the circulation of the initial washing liquid through the enzyme container at the end of the first time period;

introducing additional washing liquid into the washing liquid container, after the first time period, through the detergent container to transport the detergent into the washing liquid container for a second time period; and removing the washing liquid from the washing liquid container.

2. The method according to claim 1, further comprising the act of increasing the temperature of the washing liquid after performing the act of circulating the initial washing liquid through the enzyme container.

3. The method according to claim 1, wherein the initial washing liquid is substantially free of detergent including alkaline cleaning agents.

4. The method according to claim 1, wherein the at least one capsule comprises a polymer membrane which is permeable to the washing liquid but insoluble in water.

5. The method according to claim 1, further comprising the act of starting a second washing cycle utilizing enzymes remaining in the at least one capsule after the first washing cycle.

6. The method according to claim 5, wherein the second washing cycle repeats the acts of:

introducing an initial washing liquid into the washing liquid container;

circulating the initial washing liquid through the enzyme container and back into the washing liquid container to transport a limited quantity of the enzymes into the washing liquid container for a first time period;

stopping the circulation of the initial washing liquid through the enzyme container;

introducing additional washing liquid into the washing liquid container after the first time period through the detergent container to transport the detergent into the washing liquid container for a second time period; and removing the washing liquid from the washing liquid container.

7. A method for washing objects in a washing device including a washing liquid container, an enzyme container, and a detergent container, the method comprising the acts of:

providing enzymes in the enzyme container, the enzymes being retained in at least one capsule provided in the enzyme container;

providing a detergent in the detergent container;

starting a first washing cycle including the acts of:

circulating washing liquid through the enzyme container into the washing liquid container to transport a limited quantity of the enzymes retained in the at least one capsule into the washing liquid container, the at least one capsule being permeable to said washing liquid but insoluble in water;

stopping the circulation of the washing liquid through the enzyme container;

passing additional washing liquid through the detergent container, after stopping the circulation of the washing liquid through the enzyme-container, to transport the detergent into the washing liquid container; and removing the washing liquid from the washing liquid container;

starting a second washing cycle utilizing enzymes remaining in the at least one capsule after the first washing cycle, the second washing cycle including the acts of:

circulating washing liquid through the enzyme container into the washing liquid container to transport a limited quantity of the enzymes retained in the at least one capsule into the washing liquid container;

stopping the circulation of the washing liquid through the enzyme container;

passing additional washing liquid through the detergent container, after stopping the circulation of the washing liquid through the enzyme-container, to transport the detergent into the washing liquid container; and removing the washing liquid from the washing liquid container.

8. The method according to claim 7, further comprising the act of increasing the temperature of the washing liquid after performing the act of circulating the washing liquid through the enzyme container.

9. The method according to claim 7, wherein the washing liquid circulated through the enzyme container is substantially free of detergent including alkaline cleaning agents.

10. The method according to claim 7, wherein the enzymes are macroscopically encapsulated in a polymer membrane which is permeable to the washing liquid but insoluble in water.

11. A method for washing objects in a washing apparatus including a washing liquid container, an enzyme container containing at least one capsule permeable to washing liquid but insoluble in water and containing catalytically-acting enzymes, and a detergent container containing detergent, the method comprising:

introducing initial washing liquid into the washing liquid container;

upon the first initial washing liquid reaching a predetermined level, circulating the washing liquid between the washing liquid container and the enzyme container for a first time period to dissolve a limited quantity of enzymes contained in the at least one capsule to catalyze a first washing process;

after the first time period, introducing additional washing liquid into the washing liquid container through the detergent container for a second time period to transport detergent from the detergent container into the washing liquid container for a second washing process; and removing the washing liquid from the washing liquid container.

12. The method according to claim 11, further comprising:

increasing the temperature of the washing liquid after circulating the washing liquid through the enzyme container.

13. The method according to claim 1, wherein the initial washing liquid is substantially free of detergent including alkaline cleaning agents.

14. The method according to claim 11, wherein the catalytically-acting enzymes are macroscopically encapsulated in the at least one capsule which comprises a polymer membrane which is permeable to the washing liquid but insoluble in water.

15. The method according to claim 11, further comprising:

filtering the initial washing liquid.

16. The method according to claim 15, wherein filtering the initial washing liquid comprises filtering the initial washing liquid as it is circulated from the washing liquid container to the enzyme container.

17. The method according to claim 15, wherein filtering the initial washing liquid comprises filtering the initial washing liquid as it is circulated from the enzyme container to the washing liquid container.

18. The method according to claim 11, further comprising:

circulating second initial washing liquid between the washing liquid container and the enzyme container utilizing enzymes remaining in the at least one capsule after the first washing process to catalyze a third washing process;

passing second additional washing liquid through the detergent container to transport detergent from the detergent container into the washing liquid container for a fourth washing process; and removing all of the second washing liquid from the washing liquid container.

19. The method according to claim 18, further comprising:

increasing the temperature of the second initial washing liquid after circulating the second initial washing liquid through the enzyme container.

20. The method according to claim 18, wherein the second initial washing liquid is substantially free of detergent including alkaline cleaning agents.

* * * * *